United States Patent [19]

Lisec

[11] Patent Number: 4,885,926

[45] Date of Patent: Dec. 12, 1989

[54] APPARATUS FOR THE PRODUCTION OF SPACER FRAMES

[76] Inventor: Peter Lisec, Bahnhofstrasse 34, A-3363 Amstetten-Hausmening, Austria

[21] Appl. No.: 192,164

[22] Filed: May 10, 1988

[30] Foreign Application Priority Data

May 11, 1987 [AT] Austria ..... 1183/87
May 18, 1987 [AT] Austria ..... 1256/87

[51] Int. Cl.[4] ..... B21D 7/00; B21D 43/00; B21D 53/74

[52] U.S. Cl. ..... 72/306; 72/422; 72/426; 72/446

[58] Field of Search ..... 72/306, 307, 323, 149, 72/217–219, 384, 426, 422, 420, 446

[56] References Cited

U.S. PATENT DOCUMENTS

| | | | |
|---|---|---|---|
| 3,606,786 | 9/1971 | Taylor | 72/217 |
| 3,874,048 | 4/1975 | Millar et al. | 72/422 |
| 4,597,279 | 7/1986 | Lisec | 72/306 |
| 4,766,756 | 8/1988 | Shiue | 72/306 |

FOREIGN PATENT DOCUMENTS

| | | | |
|---|---|---|---|
| 0192921 | 9/1986 | European Pat. Off. . | |
| 2829444 | 1/1980 | Fed. Rep. of Germany . | |
| 2927753 | 2/1981 | Fed. Rep. of Germany | 72/149 |
| 3223881 | 7/1983 | Fed. Rep. of Germany . | |
| 3221986 | 12/1983 | Fed. Rep. of Germany . | |
| 229319 | 11/1985 | Fed. Rep. of Germany . | |
| 2449222 | 9/1980 | France . | |
| 162232 | 7/1986 | Japan | 72/306 |

*Primary Examiner*—Daniel C. Crane
*Attorney, Agent, or Firm*—Young & Thompson

[57] ABSTRACT

An apparatus for the production of spacer frames (44) by bending hollow moldings comprises two bending heads (12) displaceably arranged along a plate (10); with the aid of these bending heads, a hollow molding fed thereto can be bent into a spacer frame (44). At the rim of the plate (10) of the bending apparatus (1) lying in opposition to the bending heads (12), a conveyor slide (50) is provided which transports the hollow moldings, bent into a spacer frame (44), to a transfer device (60), this transfer device (60) lifting the spacer frames (44) conveyed thereto off the plate (10) and transfer them into a welding unit (5) for welding together the free ends (45) of the hollow molding bent into a spacer frame (44).

38 Claims, 10 Drawing Sheets

APPARATUS FOR THE PRODUCTION OF SPACER FRAMES

The present invention relates to an apparatus for the production of spacer frames for insulating glass from a hollow molding, with two bending heads arranged displaceably along a rim of a plate for bending the hollow molding into a spacer frame.

Such a frame bending apparatus has been known from German Pat. No. 3,223,881.

In this conventional frame bending apparatus, the spacer frames produced therein must be fed manually to subsequently located parts of the installation, for example a device for butt welding the free ends of the hollow molding bent into a spacer frame.

The present invention is based on the object of further developing the frame bending apparatus known from German Pat. No. 3,223,881 in such a direction that an extensively automatically operating transfer of the thus-manufactured spacer frames is possible, for example to a welding unit as conventional from EP-A1-0 192 921.

This object has been attained according to the invention by providing a transfer device pivotable with respect to the plate, in order to transfer spacer frames from the bending apparatus into a device for further transporting and/or for further processing of spacer frames.

By means of the transfer device provided in accordance with this invention, spacer frames lying on the plate of the bending apparatus can be inserted in a device (e.g. a welding unit) arranged downstream of the bending apparatus.

In case the device arranged subsequently to the bending apparatus is not located in exact opposition to the latter but rather offset laterally, then an embodiment of the invention is advantageous which is characterized in that a conveyor slide for the hollow moldings bent into spacer frames is provided at the rim of the plate in opposition to the bending heads, this slide being movable along the plate; that the conveyor slide can be moved from a starting position in opposition to the bending heads of the frame bending apparatus into a position wherein the slide is associated with a transfer device.

With the aid of the frame bending apparatus designed in accordance with this invention, the spacer frame ejected from the bending heads and conveyed downwardly along the inclined plate of the frame bending apparatus are moved by the conveyor slide to the transfer device, seized by the latter, and inserted in a unit arranged subsequently to the frame bending apparatus for welding the free ends of the hollow moldings, bent into spacer frames, together. A unit for welding the hollow molding to an all-around closed spacer frame is known, as mentioned above, from EP-A1-0 192 921 and comprises a supporting wall standing substantially vertically and being inclined rearwardly to a slight extent, the spacer frames being in contact with this wall during welding.

Additional features and details of the invention can be seen from the dependent claims, directed to advantageous further developments of the apparatus of this invention, and from the following description of a preferred embodiment.

Figure 1:
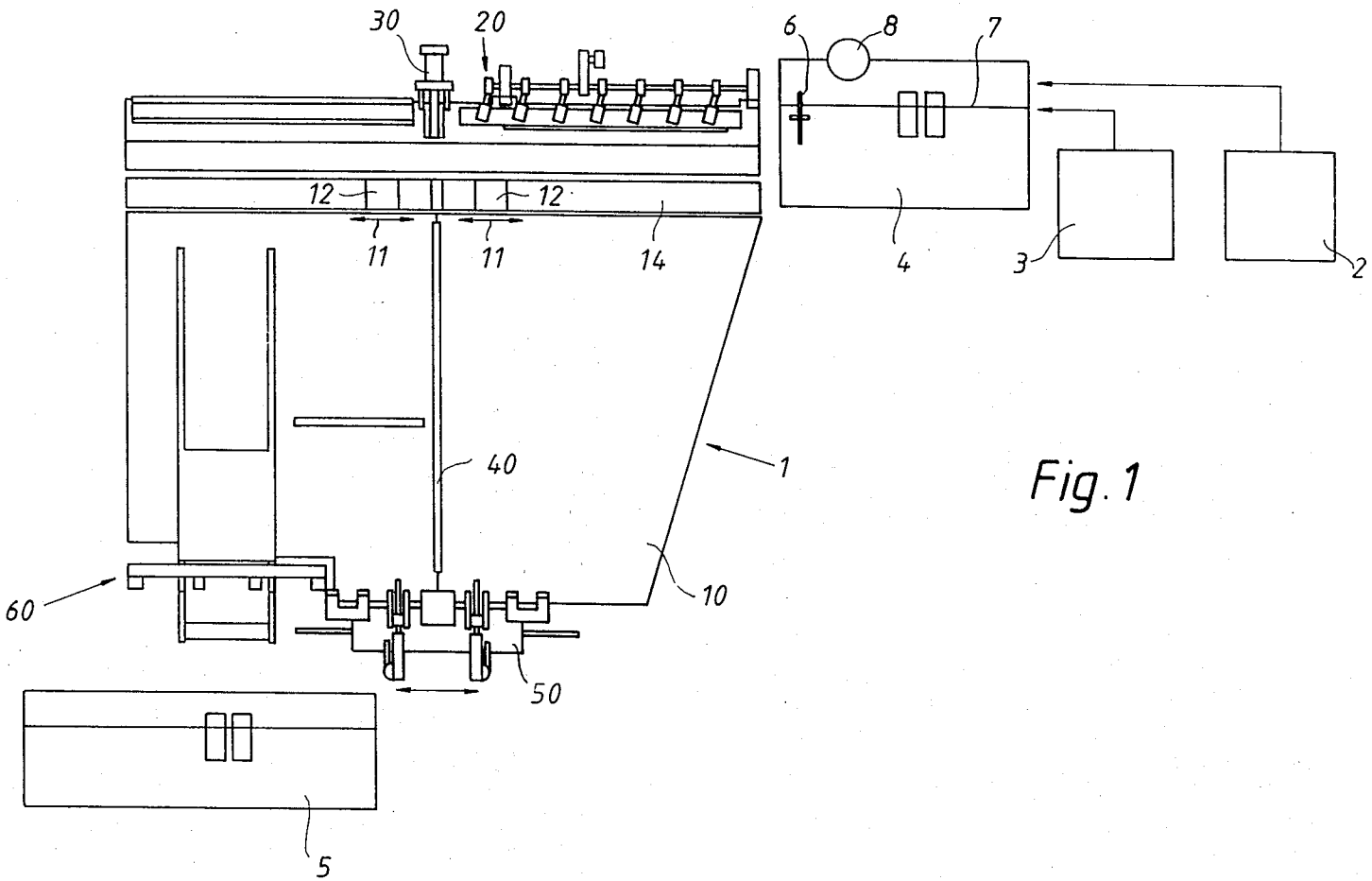
FIG. 1 shows schematically and in a plan view an apparatus for producing a spacer frame for insulating glass, with parts of the installation located upstream and downstream thereof.

A bending apparatus 1, illustrated in FIG. 1, is fed with hollow moldings to be bent into spacer frames, either from a roll-shaping device 2 wherein hollow moldings are formed from sheet-metal strips, or from a magazine 3. In case hollow moldings are fed from a magazine 3, the hollow moldings are welded together into endless hollow moldings in a welding unit 4 which can be of a structure, for example, as disclosed in EP-A1-0 192 921.

The spacer frames 44 produced in the bending apparatus 1 are then transported to a further welding unit 5 wherein the free ends 45 of the hollow molding, bent into a spacer frame 44, are butt welded together. The welding unit 5 likewise can be designed as known in principle from EP-A1-0 192 921, the welding unit 5 exhibiting a supporting wall inclined somewhat toward the rear, the spacer frames 44 being in contact with this wall during the welding step.

Between the welding unit 4 and the bending apparatus 1, a cutting to length mechanism, designed, for example, as a circular saw 6, is provided which saws off sections from the hollow molding fed thereto, in correspondence with the length required for the respective spacer frame. For this purpose, a length measuring device 8, for example an incremental pickup, is arranged beside the conveying route 7 for hollow moldings and controls the saw 6.

The incremental pickup is operated by a friction wheel, a pressure roller that can be urged against the hollow molding being arranged in opposition to this wheel. Between the length measuring device 8 and the saw 6, a drive roll is furthermore provided for conveying the hollow moldings.

The magazine 3 for hollow moldings can be designed as an endless conveyor magazine. Hollow moldings withdrawn from the endless conveyor magazine are fed by means of a vibrating conveyor into the conveying route 7 for hollow moldings.

The bending apparatus 1 comprises a plate 10 inclined by about 10°-30° with respect to the horizontal. In the zone of the upper rim of the plate 10, two bending heads 12 are provided, displaceable in the direction of the double arrows 11. A clamp 13 is arranged in the center between the two bending heads 12, this clamp retaining hollow moldings inserted in the bending heads 12 during the bending process.

In order to support the hollow moldings before and during the bending step, a textile strip 14 is provided on both sides of each bending head 12, as a flexible cover strip for the slot wherein the bending heads 12 travel along the plate 10. The cover strips 14 are guided over guide rolls 15 arranged, on the one hand, in the zone of the clamp 13 and, on the other hand, in the zone of the lateral edges of the plate 10.

The bending heads 12 comprise the ejector brackets and deflectors known from German Pat. No. 3,223,881 in order to effect the step of ejecting hollow moldings bent into spacer frames 44 from the bending heads 12.

Figure 2:
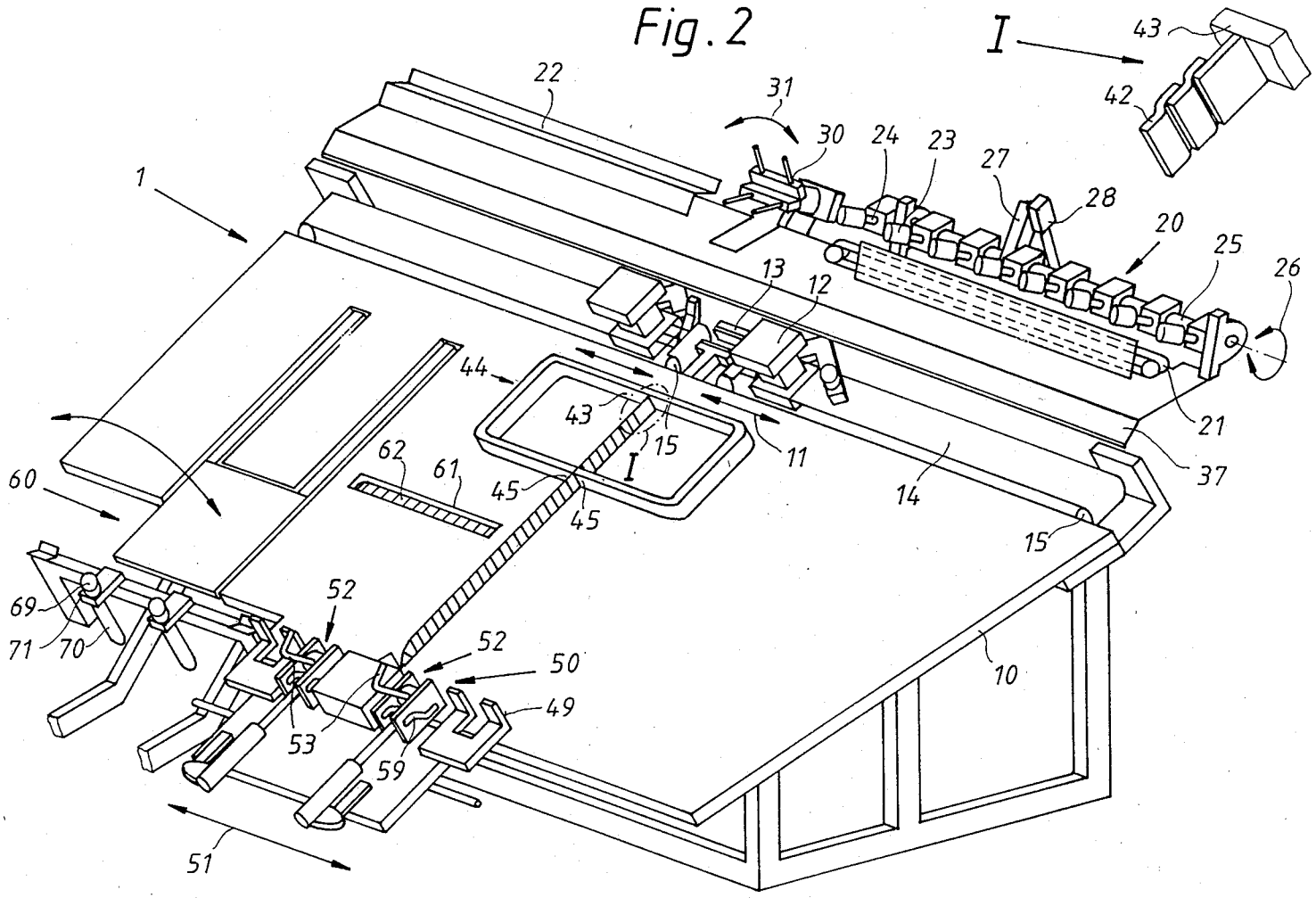
FIG. 2 shows, in an oblique view, a bending apparatus.
Figure 3:
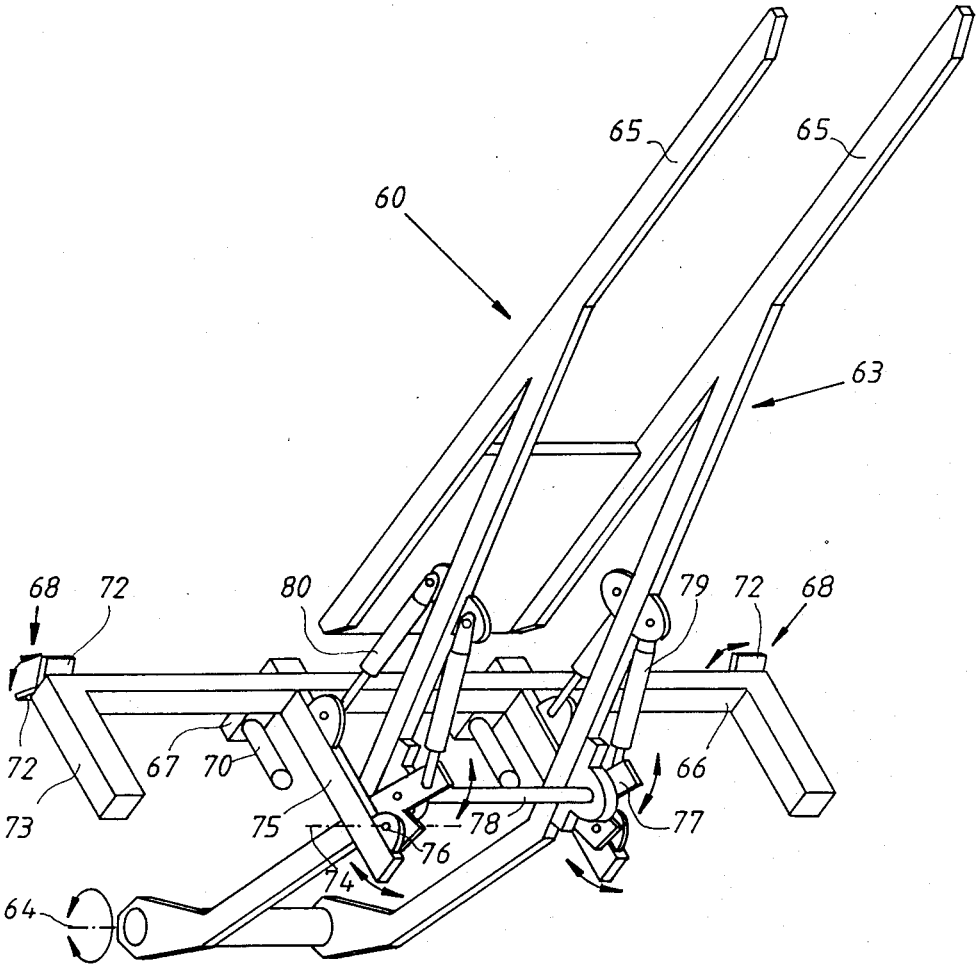
FIG. 3 shows a detail of the apparatus according to FIG. 2.

A conveying means 20 for feeding hollow moldings is provided in parallel to the rim of the plate 10, along which the bending heads 12 can be moved. This conveying means 20 comprises two sections, the section lying on the right in FIG. 2 exhibiting an endless conveying member 21, whereas the section lying on the left in FIG. 2 is designed as a slideway 22.

The endless conveying member 21 is associated with contact rollers 23 that can be brought from above into contact with a hollow molding to be fed. The contact rollers 23 are mounted by way of their axles 24 to a shaft 25 common to all of them, this shaft being rotatable in parallel to the conveying direction (double arrow 26). For this purpose, a guide arm 27 is connected to the shaft 25; this arm can be swung about with the aid of a pressure medium motor 28.

Furthermore, a gripper 30 is provided above the plate 10 which can seize a hollow molding lying on the conveying means 20. By means of a pivoting motion (double arrow 31) of the gripper 30, the hollow molding is transferred from the conveying means 20, while being twisted about its longitudinal axis, into the clamp 13 of the bending apparatus 1. By the twisting about its longitudinal axis, the hollow molding, which rests with one of its broad sides (preferably the side subsequently constituting the outer side of the spacer frame) on the conveying means 20, is turned so that it stands on edge in the clamp 13, the clamp 13 engaging the two broad sides of the hollow molding.

The gripper 30 comprises a supporting arm 32 angled several times and pivotable about an axle 33 located below the conveying means 20 and oriented in parallel to the latter. For this purpose, a pressure medium motor, not shown in detail, is provided.

Figure 7:
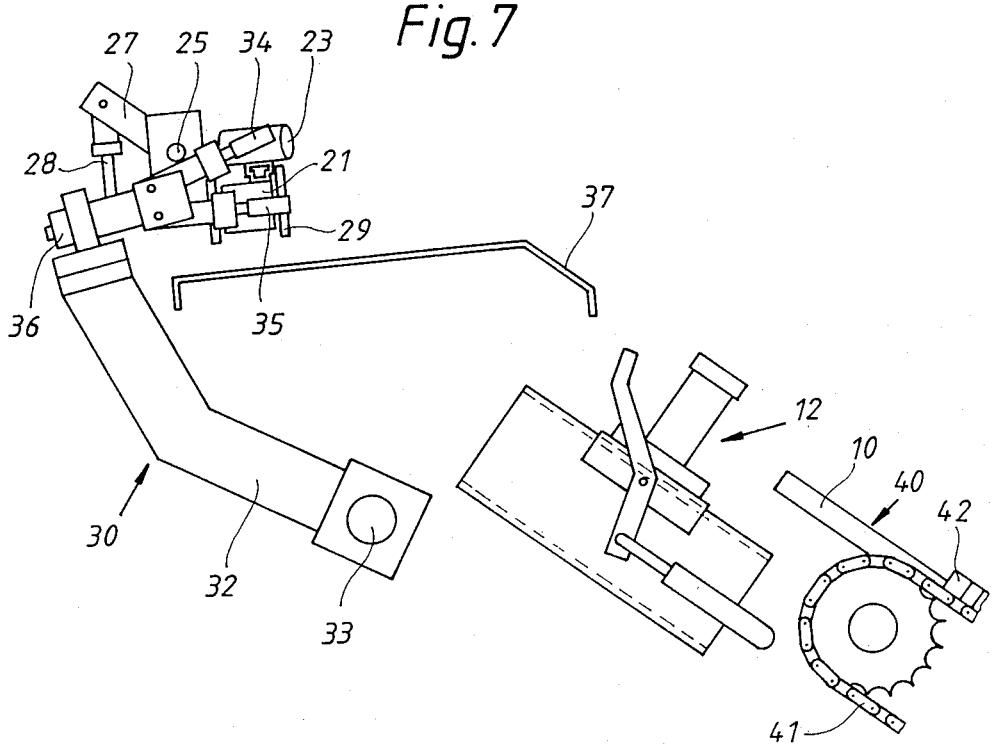
FIG. 7 shows, in a lateral view, a gripper for transferring hollow moldings from the conveying means into the bending heads.
Figure 8:
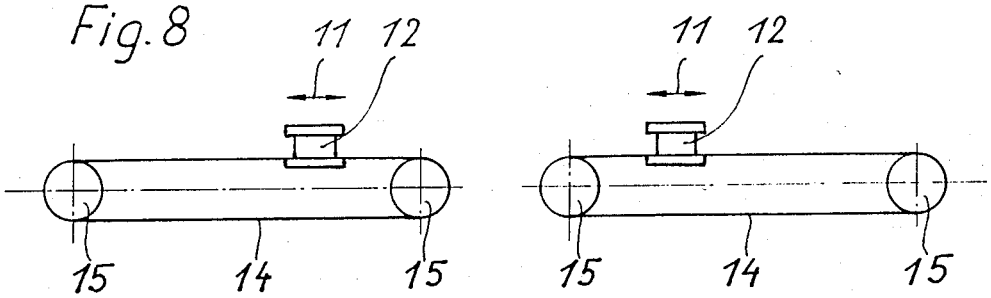
FIG. 8 is a schematic elevational view of the flexible strips that cover the slot in which the bending heads move.
Figure 9:
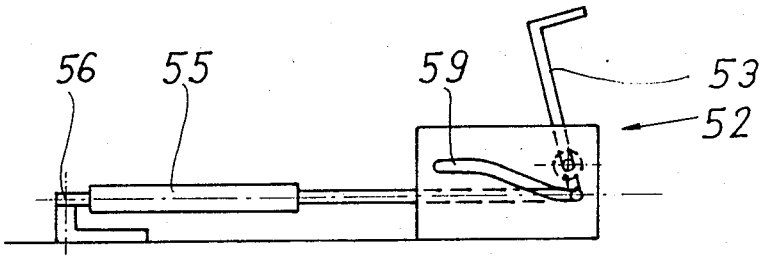
FIGS. 9 and 10 are schematic elevational views of the operating mechanism of the clamping jaws.
Figure 10:
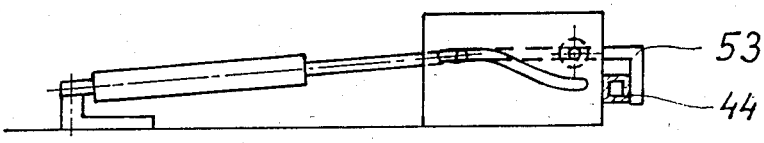

The gripper 30 comprises two clamping jaws 34, 35, each having two tines; these clamping jaws can be brought into contact from below and, respectively, from above with a hollow molding lying on the conveying means 20. In order to move the clamping jaws 34, 35, the latter are coupled with a drive motor 36. FIG. 7 shows that the clamping jaws 34, 35 of the gripper 30 are arranged, in the starting position of the latter, in the zone of the conveying route of the conveying means 20. In the position of the gripper 30 associated with the clamp 13, the tines of its clamping jaws 34, 35 are located on both sides of the jaws of the clamp 13.

Furthermore, a guide surface 37 is provided between the conveying route 20 and the path of motion of the bending heads 12; the sections of the hollow molding extending on both sides of the gripper 30 slide along this guide surface, while the hollow molding is transferred from the conveying device 20 into the bending heads 12, onto the cover strips 14.

The conveying route 20 is furthermore associated with a length measuring device, for example an incremental pickup coupled with a guide roller for the endless conveying member 21, and a light barrier (not shown) is further associated with the conveying route, between the end of the conveying member 21 on the delivery side and the gripper 30.

Figure 4:
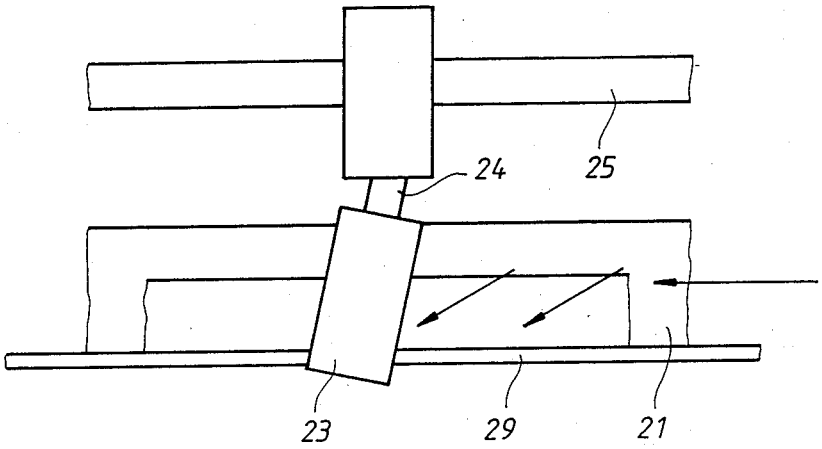
FIG. 4 shows a detail of the conveying means.

The pressure rollers 23 can be oriented somewhat obliquely with respect to the conveying direction of the conveying means 20 so that the hollow moldings fed thereon (see FIG. 4) are pulled against a guide strip 29 located on the plate side beside the endless conveying member 21, while these moldings are being fed. Thereby, the hollow moldings are arranged with respect to the clamping jaws 34 and 35 of the gripper 30 so that they are seized by the latter in the zone of their forward ends, and secure insertion in the clamp 13 of the bending apparatus 1 is ensured.

A slot 40, oriented perpendicularly to the travel direction (double arrow 11) of the bending heads 12 is located in the plate 10 of the bending apparatus 1. An endless chain 41 guided about two guide rollers is provided in this slot 40, the upper face of the chain being disposed closely below the topside of the plate 10. Over half of its length, the chain 41 is equipped with upwardly pointing, plate-shaped extensions 42 which, with a corresponding position of the chain 41, project upwardly through the slot 40 in the plate 10. As shown in FIG. 2, the upper horizontal leg of a spacer frame 44, bent in the bending apparatus 1 and ejected from the bending heads 12, is in contact with the uppermost extension 42 of chain 41. The two free ends of the hollow molding, bent into a spacer frame 44, are in contact further down with both sides of extensions 42. By moving the chain 41, a spacer frame 44 ejected from the bending heads 12 can be transported to the lower rim of the plate 10 of the bending apparatus 1.

In the zone of the lower rim of plate 10, a conveyor slide 50 is provided which is guided along the lower rim on guide rails so that it is reciprocatable in the direction of double arrow 51 to a transfer means 60 and back again. Drive means (e.g. endless chains or the like), not shown in detail, are provided for moving the conveyor slide 50.

Two clamps 52 are arranged at the conveyor slide 50 which are used to fix in place a spacer frame 44 to the conveyor slide 50 after the spacer frame has been transported from the chain 41 to the lower rim of the plate 10. Each of the clamps 52 comprises a clamping jaw 53 having the shape of a hook, which is slidingly guided in swivel bearings 54 at the conveyor slide 50, so that these clamping jaws can be swiveled, on the one hand, under the action of pressure medium cylinders 55 and then can be moved along a contact surface 49 of the conveyor slide 50 for clamping a spacer frame 44. In order to control the movement of the clamping jaws 53 correspondingly, the connecting joints between the piston rods of the pressure medium motors 55 and the clamps 53 are guided in slots 59 arranged in guide plates, the slots 59 having approximately the shape of an S. The clamping jaws 52 are furthermore pivotable at the conveyor slide 50 about bearings 56, i.e. about axes perpendicular to the plate 10, under the effect of a pressure medium motor 57, so that the free ends 45 of the spacer frame 44 can be pressed from both sides against a centering shim 58 fixedly mounted at the conveyor slide 50.

Figure 6:
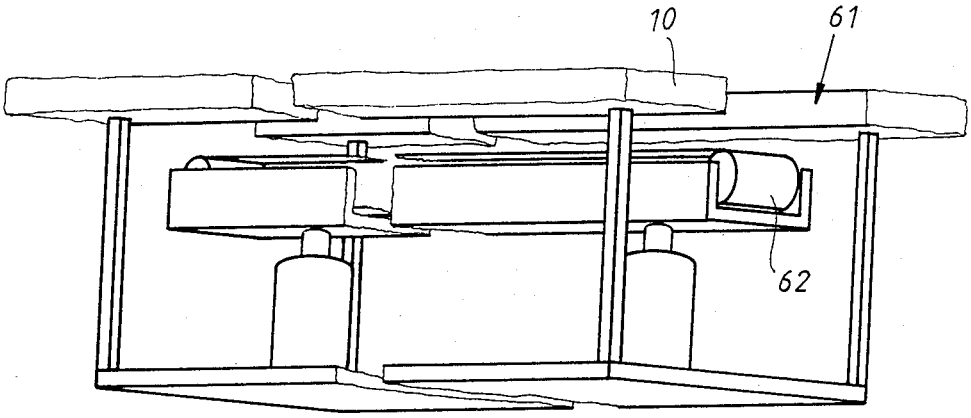
FIG. 6 shows a conveyor belt arranged so that it can be hidden in the plate of the apparatus of FIG. 2.

After a spacer frame 44 has been fixed in place at the conveyor slide 50, the latter travels to the transfer device 60; in this procedure, the movement of the spacer frame 44 along the plate 10 can be enhanced by a conveyor belt 62 provided in a further slot 61 of plate 10. The conveyor belt 62, as shown in FIG. 6, can be lifted from a position hidden underneath the plate 10 (during the bending step) into an operative position wherein it protrudes above the topside of plate 10. The conveyor belt 62 is preferably fashioned as a conveyor strip with outwardly pointing teeth of a rubber-elastic material.

The transfer device 60 is intended for lifting a spacer frame 44 off plate 10 of the bending apparatus 1 and transferring this spacer frame to a welding unit 5 arranged beside the bending apparatus 1 wherein the free ends 45 of the spacer frame 44 are butt welded together.

The transfer device 60 comprises a frame 63 pivotable about an axis 64. At the frame 63, a plate is provided and, emanating therefrom, two crossbars 65 are arranged which are contacted by the upper horizontal leg of a spacer frame 44 during transferring of the spacer frame 44.

Figure 11:
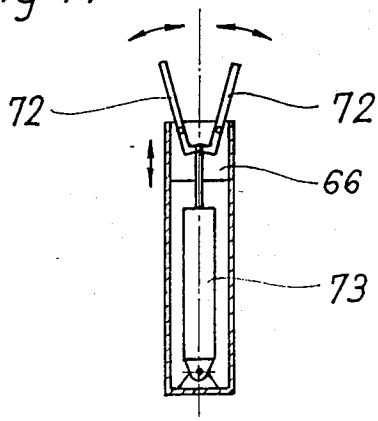
FIG. 11 is a schematic view showing the operation of one of the clamps.

The lower horizontal leg of the spacer frame 44 is retained by means of clamps 67 provided at a beam 66 of the transfer device 60 and is additionally fixed optionally by means of further clamps 68 (if the spacer frame is sufficiently long) provided at the outer ends of the beam 66. The further clamps and their operation are shown in greater detail in FIG. 11.

Figure 12:
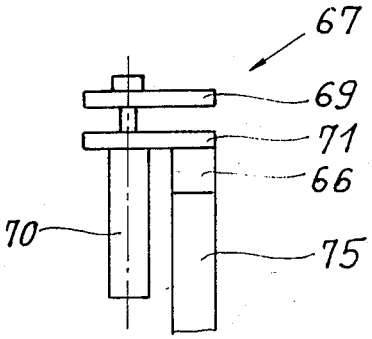
FIG. 12 is a schematic view showing the operation of another of the clamps.

The inner clamps 67 at the beam 66 include respectively one clamping plate 69 displaceable by means of a pressure medium motor 70 toward an abutment 71 rigidly affixed to the beam 66. Clamps 67 and their operation are best seen in FIG. 12.

The two outer clamps 68 comprise clamping jaws 72 pivotable in parallel to the longitudinal extension of the beam 66. For pivoting the clamping jaws 72 of the clamps 68, pressure medium motors 73 are included.

The beam 66 can be swiveled about an axis 74 oriented in parallel to the longitudinal extension of the beam and in parallel to the lower rim of the plate 10, i.e. it can be reciprocated in the direction of the plate 10. Additionally, the beam 66 can be lifted above the plate 10 and can again be lowered to beneath this plate. For this purpose, the swivel bearings 76 (axis 74) provided at the ends of arms 75 are attached to guide arms 77 attached to a shaft 78. By the operation of pressure medium motors 79, the beam 66 can be lifted and lowered, respectively, with regard to plate 10, whereas by operating the pressure medium motors 80, the beam 66 can be moved to and fro with its clamps 67 and 68 approximately in the plane of plate 10.

The just-described apparatus for producing a spacer frame 44 for insulating glass from a hollow molding operates as follows:

The frame bending apparatus 1 is fed, via the conveying means 20, with a hollow molding which has either been formed by the roll shaping device 2 or has been withdrawn from magazine 3 and endlessly welded together in the welding unit 4. During this step, the hollow molding is cut exactly to length by the saw 6 to the dimension required for producing the respective spacer frame 44. Length measurement is effected by way of the length measuring device 8, fashioned as an incremental pickup and arranged upstream of the saw 6 and downstream of the welding device 4. Furthermore, between the length measuring device 8 and the saw 6, a drive roll (not shown in the drawings) is provided for transporting the hollow molding to the conveyor means 20.

The conveying means 20 at the upper rim of the bending apparatus 1 conveys the correspondingly cut to size hollow molding for such a distance that it is stopped exactly in the center between the bending heads 12. As a result, the butt joint between the free ends 45 of the hollow molding, bent into a spacer frame 44, comes to lie precisely symmetrically with respect to the bending heads 12 and the conveyor slide 50. For this purpose, a light barrier is provided at the end of the endless conveyor 21, detecting the front end of a transported hollow molding and actuating the incremental pickup connected to the endless conveyor 21, for length measurement; this incremental pickup, considering the length of the hollow molding, arrests the drive means for the endless conveyor 21 once the center of the hollow molding lies exactly between the bending heads 12, i.e. is aligned symmetrically with respect to the gripper 30 and/or the clamps 13. After the hollow molding has thus been correctly positioned, the contact rollers 23 are lifted off the endless conveyor 21 by operating the pressure medium motor 28, and the gripper 30 is actuated and inserts the hollow molding in the clamp 13 between the bending heads 12. Then the hollow molding is clamped in place in the on-edge position by the clamp 13.

Before performing the bending process, the chain 41 provided in slot 40 of plate 10 is positioned so that the uppermost of the extensions 42 fastened thereto assumes approximately the position indicated in FIG. 2. At this point in time, a spacer frame 44 is produced by bending the hollow molding, for example as described in German Pat. No. 3,223,881. After operating the ejectors at the two bending heads 12, the spacer frame 44 assumes the position shown in FIG. 2, i.e. its upper horizontal leg 43 is in contact with the uppermost extension 42 at the chain 41. The two free ends 45 of the hollow molding, still to be welded together, are in bilateral contact with the upwardly oriented extensions 42 of the chain 41 and/or are disposed beside the extensions 42. Thereupon, the chain 41 is set into motion and the spacer frame 44 is transported along the plate 10 downwardly to the conveyor slide 50. The lower horizontal leg of the spacer frame 44 actuates a capacitive proximity switch, not shown, provided in the plate 10 in the zone of the slide 50, whereupon the two clamps 52 are operated and maintain the spacer frame 44 in contact with the clamping surface 49 of the conveyor slide 50. Thereupon, the two clamps 52 are made to approach each other by activating the pressure medium motor 57 so that the two free ends 45 of the spacer frame 44 are in contact with the centering shim 58. If the stroke of the two clamps 52 is larger than the free spacing of the ends 45 from the centering shim 58, then the clamping jaws 53 slide through along the spacer frame 44.

Then the conveyor slide 50 moves, with the spacer frame 44 held thereby, to the transfer device 60 at the end of plate 10.

In order to avoid warping in case of relatively large-sized spacer frames 44 during the transport thereof, the conveying member 62 is lifted in the slot 61 of plate 10 and supports transportation of the spacer frame 44 to the transfer device 60.

Figure 13:
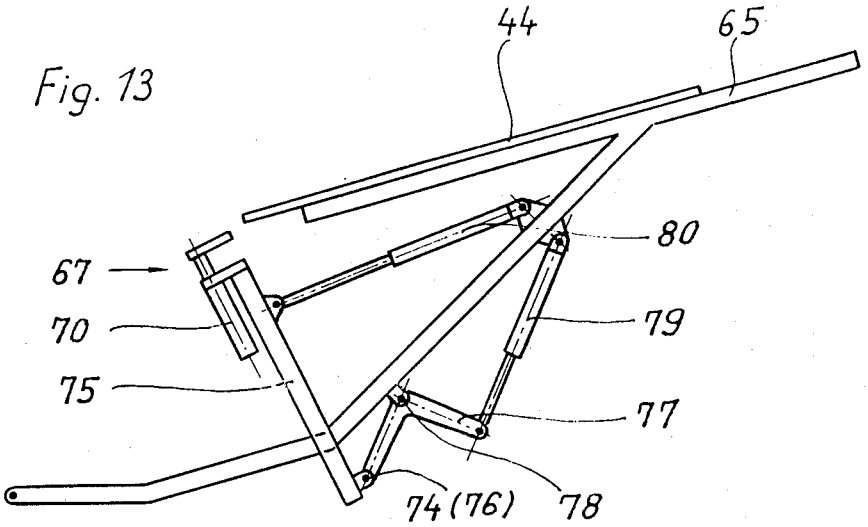
FIGS. 13–15 are schematic views showing the sequence of operation the clamp of FIG. 12.
Figure 14:
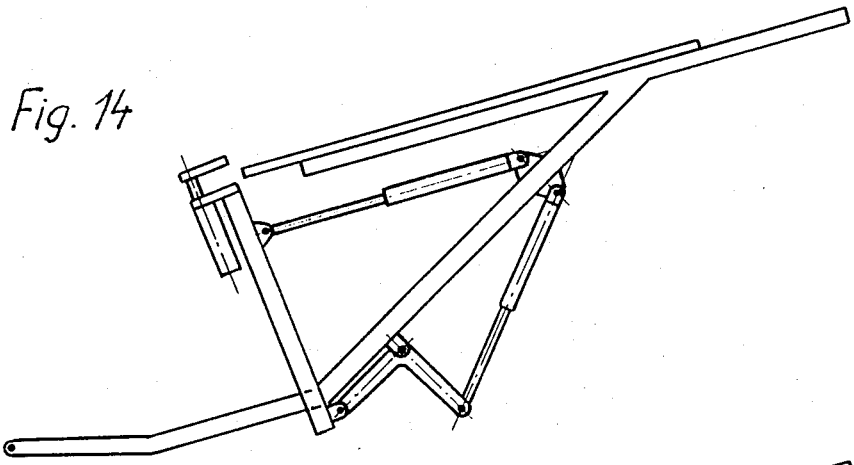
Figure 15:
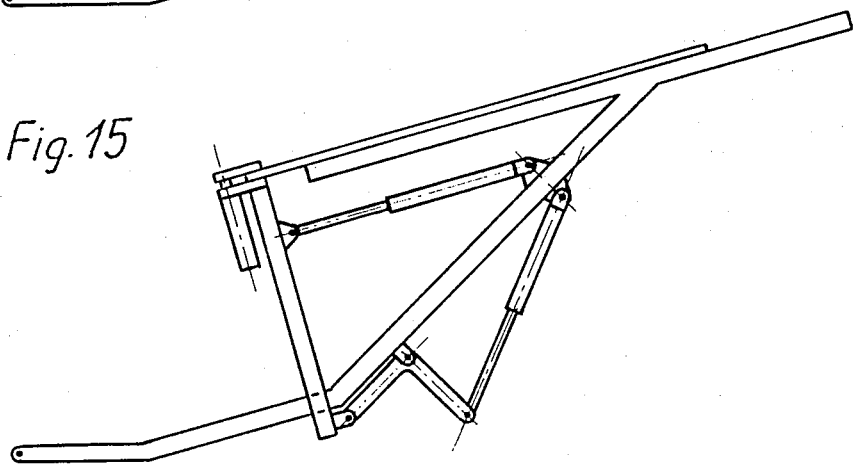

Prior to arrival of the conveyor slide 50, the beam 66 has been shifted downwardly with its clamps 67 and 68 (rotation about shaft 78) so that the clamps 67 and 68 do not impede the feeding of the spacer frame 44. With the clamps 67 and 68 being opened, the beam 66 of the transfer device 60 is now lifted (operation of pressure medium motors 79, see FIG. 13), and moved (operation of pressure medium motors 80, see FIG. 14) to the lower leg of the spacer frame 44 fixedly clamped to the slide 50. Thereupon the clamps 67 and, in case of an adequately long spacer frame, also the clamps 68 are closed (operation of pressure medium motors 70, see FIG. 15) so that the spacer frame 44 is fixed with its lower horizontal leg at the transfer device 60. The clamps 52 of the conveyor slide 50 are opened, the beam 66 of the transfer device 60 moves backwards (operation of pressure medium motors 80), and the slide 50 can be moved back into its starting position illustrated in FIG. 2.

Now the transfer device 60 swings about its axle 64 and places the spacer frame 44 into the welding unit 5 connected downstream of the bending apparatus 1. For inserting the spacer frame 44 in the welding unit 5, the beam 66 with clamps 67 and 68 is moved once again, i.e. with the transfer device 60 being swung upwardly, is moved downwards by the pressure medium motors 80. The clamps 67, 68 open up, and the beam 66 moves upwardly again, whereupon the transfer device 60 is once again swung back into its starting position (FIG. 2).

During this activity of the transfer device 60, the conveyor slide 50 is moved back into its readiness position indicated in FIG. 2 in order to take over the subsequent spacer frame 44 that has been bent in the meantime, and transport same again to the transfer device 60.

After the transfer device 60 has been swung back into its readiness position shown in FIG. 2, the beam 66 is lowered again so that the clamps 67 and 68 are located below the topside of plate 10 of the bending apparatus 1.

In accordance with an embodiment, not shown, the transfer device 60 can be arranged at the lower rim of the plate 10 of the bending apparatus 1 symmetrically to the gripper 30 for transferring the hollow moldings, to be bent into spacer frames 44, from the cnveying means 20 into the clamp 13 and the bending heads 12. In this embodiment, no conveyor slide 50 is included, and the device for further processing the spacer frames 44 (e.g. the welding unit 5) is likewise arranged symmetrically to the gripper 30 and to the clamp 13.

In place of the endless chain 41 equipped with extensions 42, it is possible in the apparatus of this invention to provide a carriage as the conveying facility which moves the spacer frames, lifted out of the bending heads 12 and resting on the plate 10, to the lower rim of the plate 10, i.e. to the conveyor slide 50 and/or directly to the transfer device 60. This carriage is reciprocatable on guides (e.g. guide rods) oriented perpendicularly to the conveying direction of the conveying means 20 and in parallel to the plane of the plate 10. Furthermore, this carriage is equipped with clamps which seize the spacer frame 44 and release it again as soon as the spacer frame 44 is aligned with respect to the conveyor slide 50 and, respectively, the transfer device 60 and has been seized by the clamping means 52 and, respectively, 67, 68 provided thereat.

An embodiment of a bending apparatus 1 equipped with a carriage as the conveying means is shown in FIGS. 16–19.

In this embodiment of the bending apparatus 1, which otherwise has the same structure as described with reference to FIGS. 1–15, a slot 100 is provided in the plate 10 of the bending apparatus 1, this slot extending downwards from clamp 13. A carriage 101 and a guide means 102 for the free ends 45 of the hollow molding bent into a spacer frame 44 are arranged in this slot 100. The free ends 45 of the spacer frame 44 are guided by this guide means 102 in such a way that they are located on both sides of the centering shim 58 of the conveyor slide 50 once the lower horizontal leg of the spacer frame 44 has been moved to the conveyor slide 50.

Figure 17:
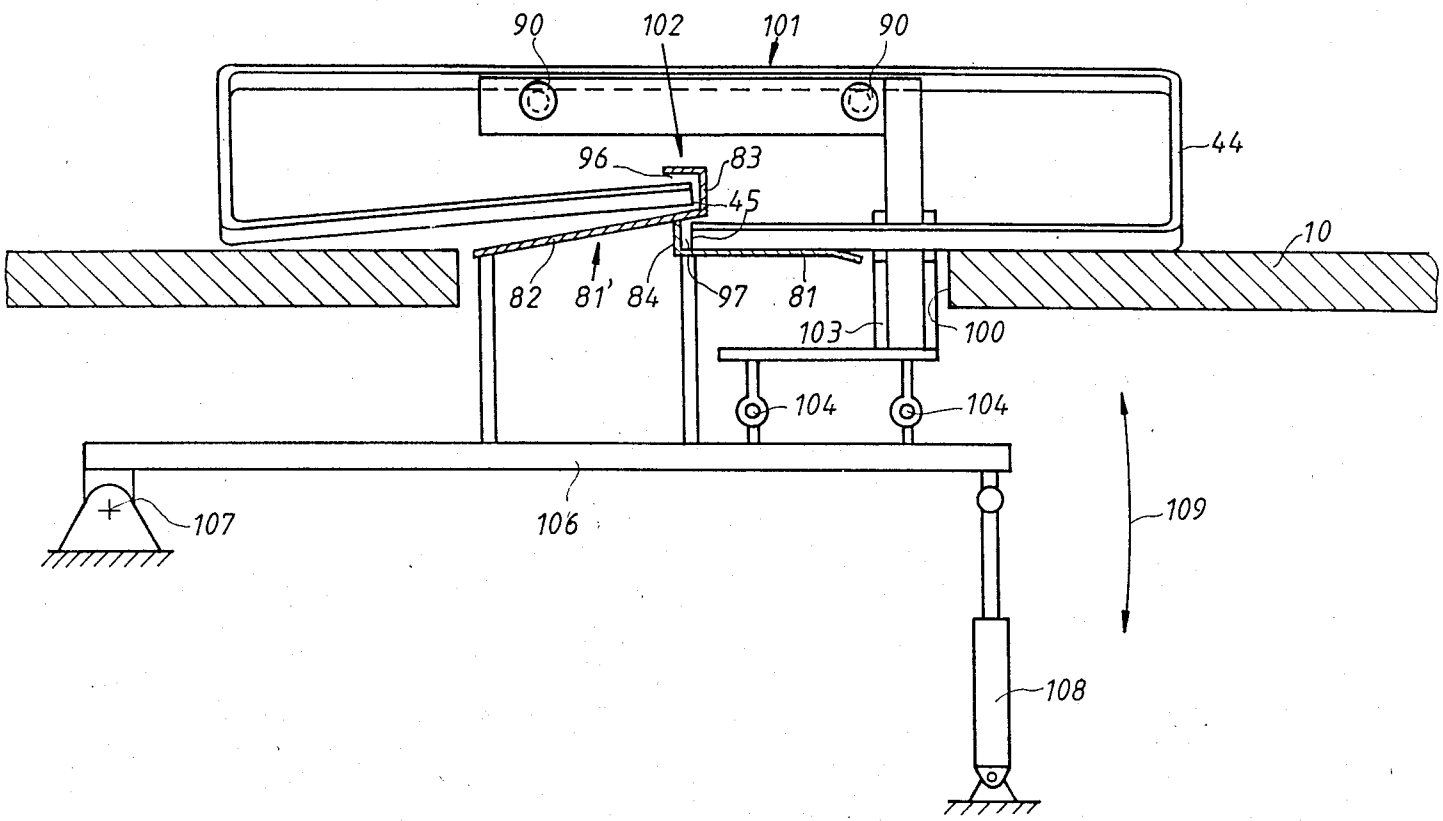
FIG. 17 shows a section along line 17–17 in FIG. 16.

The carriage 101 is displaceably guided by way of its frame 103 on guide rails 104 extending in parallel to the slot 100, in the direction of double arrow 105. The guide rails 104 are attached to a trestle 106 which also carried the guide means 102. The trestle 106 can be swung in the frame of the bending apparatus 1 about an axis 107 parallel to the slot 100, by means of a pressure medium motor 108 (arrow 109) so that the carriage 101 and the guide means 102 can be lowered below the plate 10 of the bending apparatus 1 when the conveyor slide 50 transports a spacer frame 44 to the transfer device 60. The pressure medium motor 108 is supported in the frame of the bending apparatus 1, as indicated in FIG. 17.

The guide means 102 consists of two sheet-metal profiles 81 and 81' extending in the longitudinal direction of the slot 100. The sheet-metal profiles 81' has a leg 82 located with its free edge flush with the topside of the plate 10 of the bending apparatus 1 and leading away from the plate 10 obliquely in the upward direction. At its other edge, the sheet-metal profile 81' is angled in the shape of a U and thus forms a groove 96 to accommodate one end 45 of the hollow molding bent into a spacer frame 44. The sheet-metal profile 81 of the guide means 102 is essentially of an L shape, its upwardly angled leg 84 adjoining the underside of the leg 82 of the sheet-metal profile 81'. As can be seen from FIG. 17, the upwardly angled leg 84 of sheet-metal profile 81 is arranged to be offset with respect to the vertical section 83 of the U-shaped angled portion of sheet-metal profile 81' so that the free ends 45 of the hollow molding, bent into a spacer frame 44, can overlap.

Figure 16:
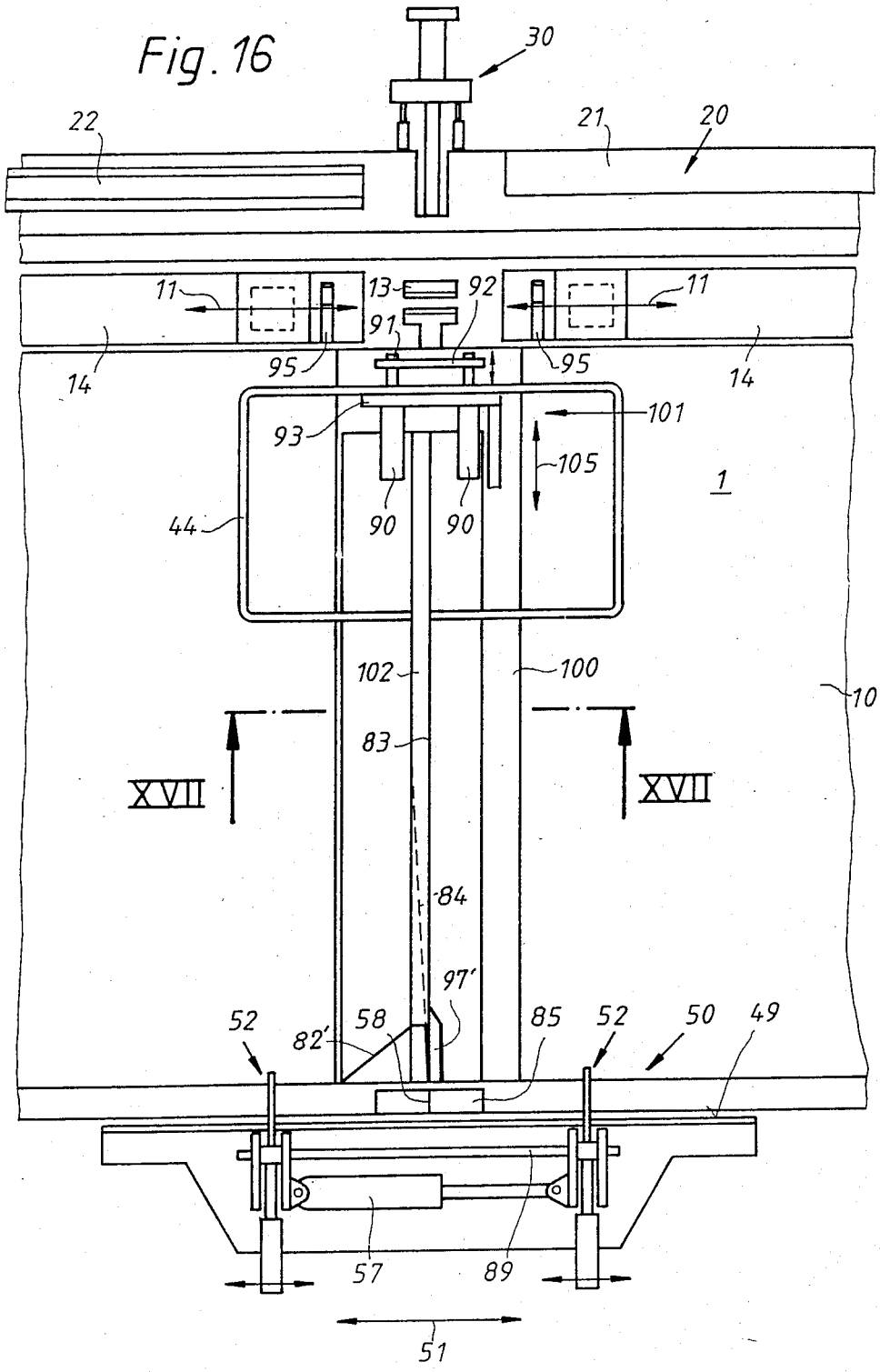
FIG. 16 shows an embodiment with a guide means for the free ends of the hollow molding bent into a spacer frame and with a conveying means for conveying a spacer frame to the lower rim of the plate of the bending apparatus.
Figure 18:
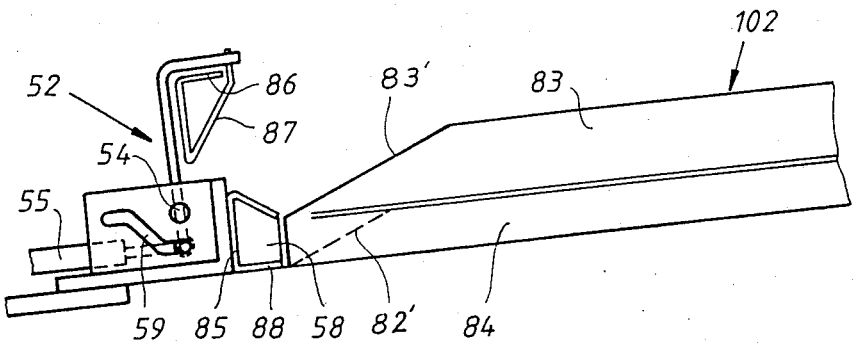
FIG. 18 shows the bottom end of the guide means and parts of the conveyor slide.

As indicated in FIG. 16, the leg 84 of the sheet-metal profile 81 deviates at least in its bottom section from its extension oriented in parallel to the slot 100 so that it terminates at the lower end of the guide means 102 exactly below the vertical section 83 of the angled portion of the shape of a U-profile of the sheet-metal profile 81'. To enable the free ends 45 of the hollow molding to be brought into coplanar relationship at the proper level, vertical section 83 of the U-shaped angled portion of sheet-metal profile 81' terminates at its lower end, as seen in FIG. 18, in a more sharply downwardly inclined section whose upper wall is indicated at 83'. To accommodate the adjacent end 45 that is thus being brought downwardly into alignment with the other end 45, the leg 82 of profile 81' is bent about an oblique bend line 82' shown in FIGS. 16 and 18, so that the lower end edge of leg 82 is in line with the upper surface of plate 10.

In this way, the free ends 45 of the spacer frame 44 are guided so that they are located on both sides of the centering shim 58 of the conveyor slide 50 when the spacer frame 44 has been moved by the carriage 101 so far downwardly that the lower horizontal leg of the spacer frame 44 is in contact with the conveyor slide 50 and/or its contact surface 49.

As illustrated in FIGS. 16 and 18, the centering shim 58 of the conveyor slide 50 is disposed in a U-shaped profile 85 ensuring that the free ends 45 of the spacer frame 44 are arranged on both sides of the centering shim 58 and do not come to lie above or below the same.

As shown especially in FIG. 18, the clamps 52 of the conveyor slide 50 are equipped with hold-down springs 86, the free legs 87 of which, when the clamps 52 are swiveled, urge the lower horizontal leg of the spacer frame 44 downwards into contact with the lower horizontal leg 88 of the U-shaped profile 85.

Figure 5:
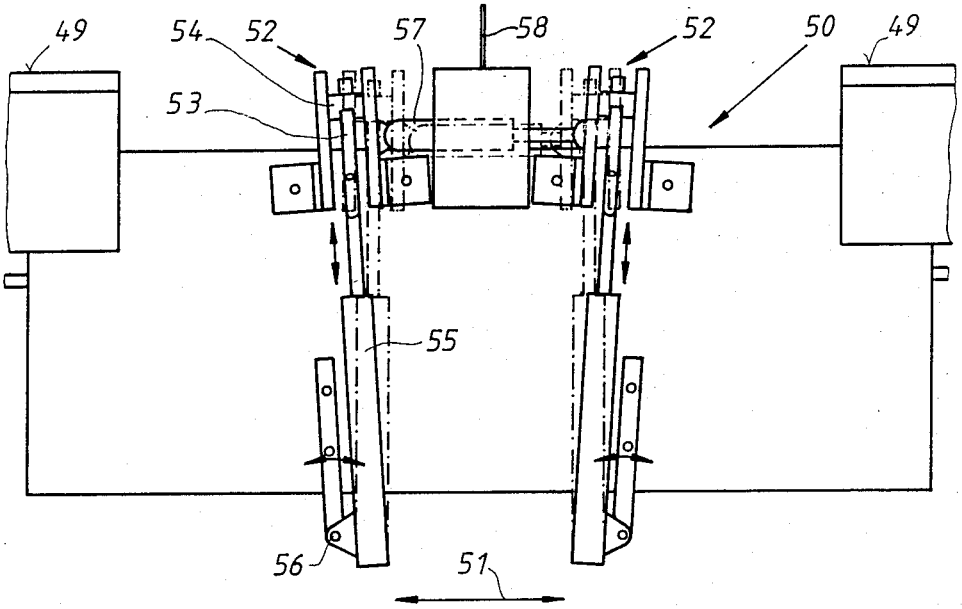
FIG. 5 shows another detail of the apparatus according to FIG. 2.

The clamps 52 of the conveyor slide 50 are guided, in the embodiment shown in FIG. 16, by guide baffles on a guide rail 89 extending in parallel to the lower edge of the plate 10 of the bending apparatus and attached to the conveyor slide 50 so that, upon operation of the pressure medium cylinder 57, these clamps, in contrast to the embodiment shown in FIG. 5, do not execute a pivoting motion but rather are moved in parallel to themselves toward each other in order to urge the free ends 45 of the hollow molding, bent into a spacer frame 44, against the centering shim 58.

Figure 19:
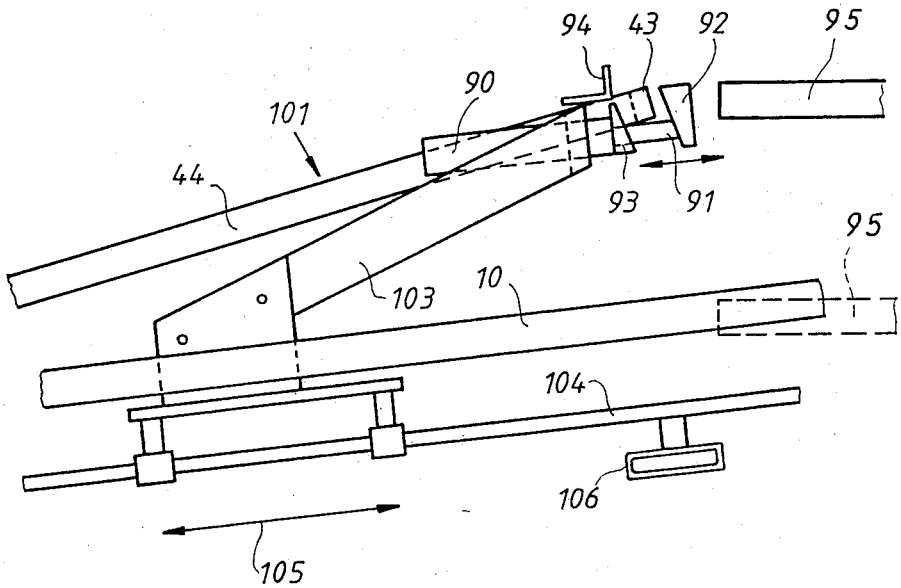
FIG. 19 shows the conveying means in a lateral view.

Two pressure medium motors 90 are mounted on the frame 103 of the carriage 101, the piston rods 91 of which carry a clamping jaw 92. A second clamping jaw 93 is arranged on the frame 103 of the carriage 101. As shown in FIG. 19, the clamping surfaces of the clamping jaws 92 and 93 are inclined with respect to the plane of plate 10 in order to take into account the oblique positioning of the frame 44 (FIG. 19).

A guide plate 94 is furthermore provided on the frame 103 of the carriage 101, this plate securely guiding the upper horizontal leg 43 of the spacer frame 44 between the clamping jaws 92 and 93 while the same is lifted out of the bending heads 12 by the extractor brackets 95 of the bending heads 12 and is transferred to the carriage 101. Brackets 95 can be constructed and actuated as in U.S. Pat. No. 4,597,279, the disclosure of which is incorporated herein by reference. As shown in FIG. 19, the upper horizontal leg 43 of the spacer frame 44 initially rests on the piston rods 91 of the pressure medium motors 90.

The embodiment described with reference to FIGS. 16 through 19 operates basically in the same way as the embodiment disclosed in connection with FIGS. 1 through 15, but with the following differences:

After a hollow molding has been bent by the bending heads 12 into a spacer frame 44, the clamps of the bending heads 12 are opened and their ejector brackets 95 lift the upper horizontal leg 43 of the spacer frame 44, as seen at the right of FIG. 19, in which the upper and lower positions of brackets 95 are shown. The latter slides along the ejector brackets 95 downwards until it drops onto the piston rods 91 of carriage 101. During this activity, the free ends 45 of the spacer frame 44 are accommodated in the grooves 96 and 97 of the guide means 102.

At this point, the clamping jaw 92 is moved, by operating the pressure medium motors 90, toward the fixed clamping jaw 93, and the upper horizontal leg 43 of the spacer frame 44 is fixed by clamping. By means of a drive mechanism not shown in detail, for example an endless chain hoist or the like, the carriage 101 is then moved downwardly along the plate 10, entraining the spacer frame 44, until the lower horizontal leg of the spacer frame 44 arrives at the conveyor slide 50. Now, the clamps 52 of the conveyor slide 50 are actuated by their pressure medium cylinders 55, the free legs 87 of the hold-down springs 86 pressing the free ends 45 of the spacer frame 44 against the leg 88 of the profile 85; these free ends 45 have been guided by the grooves 96 and 97 so that they are located on both sides of the centering shim 58. A guide blade 97' at the lower end of channel 97 positively guides the adjacent end 45 into profile 85. After the clamps 52 thus have fixed the position of the spacer frame 44 at the conveyor slide 50, the clamp of carriage 101, consisting of the clamping jaws 92 and 93, is opened, and the frame 106 is pivoted about its axis 107 by operation of the pressure medium motor 108 until the guide means 102 as well as the carriage 101 are located underneath the plate 10.

At this point in the process, the conveyor slide 50 is set into motion; during its movement, the pressure medium motor 57 is additionally actuated in order to make the clamps 52 approach each other so that the free ends 45 of the spacer frame 44 contact from both sides the centering shim 58 of the conveyor slide 50. As soon as the spacer frame 44 has been moved by the conveyor slide 50 out of the region of the slot 100, the guide means 102 and the carriage 101 are lifted again, and the carriage 101 is moved toward the upper edge of the plate 10 so that it is ready to handle the next spacer frame 44.

What is claimed is:

1. Apparatus for the production of spacer frames for insulating glass from a hollow molding, comprising a plate (10), two bending heads (12) positioned along an edge portion of said plate (10), said bending heads capable of being displaced along an axis both toward and away from one another along said edge portion to position said bending heads relative to said hollow molding at spaced locations, a transfer device (60) which is pivotable with respect to the plate (10) in order to remove spacer frames (44) from the bending apparatus (1), conveyor slide means capable of being displaced along an axis along a second edge portion of said plate (10) opposite that along which said bending heads are displaced, said conveyor slide means (50) being laterally displaceable from a position opposite said bending heads to a position adjacent transfer device (60), said transfer device (60) being pivotable about an axis parallel to the direction of movement of said conveyor slide means, and conveyor means (41,42) to convey spacer frames (44) removed from sand bending beads (12) after termination of said bending operation to said conveyor slide means (50).

2. Apparatus according to claim 1, in which said conveyor means comprises an endless chain (41) including extensions (42) protruding through a slot (40) in the plate (10).

3. Apparatus according to claim 2, in which the extensions (42) are fastened to the chain (41) in mutually overlapping relationship.

4. Apparatus according to claim 1, in which said conveying means comprises a carriage (101) with at least one clamp (92,93) that can be brought into contact with the spacer frame (44), said carriage being movable along a path parallel to the plane of the plate and perpendicular to the axis of movement of the bending heads (12).

5. Apparatus according to claim 1, in which at least two clamps (52) are provided on the conveyor slide means (50), said clamps adapted to fix a portion of the hollow molding, bent into a spacer frame (44), in position on the conveyor slide means (50).

6. Apparatus according to claim 1, and further including a centering shim (58) on the conveyor slide means (50), said shim positioned to cooperatively engage adjacent free ends (45) of said spacer frame (44).

7. Apparatus according to claim 5, in which the clamps (52) of the conveyor slide means (50) can be moved toward each other.

8. Apparatus according to claim 7, in which the clamps (52) on the conveyor slide means (50) can be moved toward each other and away from each other about axles (56) oriented perpendicularly to the plate (10), under the effect of a pressure medium motor (57).

9. Apparatus according to claim 5, in which the clamps (52) are hooks (53) accommodated in rotatable sliding bearings (54), the free ends of these hooks being coupled with pressure medium motors (55) supported on the conveyor slide means (50).

10. Apparatus according to claim 1, in which the transfer drive (60) comprises a frame (63) pivotable about a horizontal axis (64), on which frame crossbars (65) are provided for supporting a portion of said spacer frame (44) and clamps (67 and 68) for retaining the spacer frame (44) in position.

11. Apparatus according to claim 10, in which the clamps (67 and 68) for retaining the spacer frame (44) are fastened to a beam (66) parallel to an axis of rotation (64) of the transfer device (60).

12. Apparatus according to claim 11, in which the beam (66) can be lifted and lowered with respect to the frame (63) of the transfer device (60) and can be moved toward and away from said axis (64).

13. Apparatus according to claim 12, in which the beam (66) is supported by arms (75) to be pivotable about an axis (74) parallel to the said axis (64) of the transfer device (60); the pivot axis (74) for the beam (66), in turn, being supported via guide arms (77) on a shaft (78) rotatable for lifting and lowering the beam (66).

14. Apparatus according to claim 10, and in a central portion of the beam (66), a centrally-positioned pair of clamps (67) and, at both ends of the beam (66), a further pair of laterally-positioned clamps (68).

15. Apparatus according to claim 14, in which the laterally-positioned clamp pair (68) has clamping jaws (72) which engage the spacer frame (44).

16. Apparatus according to claim 14, in which the centrally-positioned clamp pair (67) has clamping jaws (69) engaging lateral portions of the spacer frame (44).

17. Apparatus according to claim 4, in which one clamping jaw (71) of the centrally-positioned clamps (67) is rigidly attached to the beam (66), and the movable clamping jaws (69) of these clamps (67) can be moved forward and backward perpendicular to the longitudinal extent of the beam (66).

18. Apparatus according to claim 15, in which the laterally-positioned clamps (68) each comprise two clamping jaws (72), both of which are movable.

19. Apparatus according to claim 1, further including a slot (61) in the plate (10) along the direction of travel of the conveyor slide means (50), and a conveying member (62) is this slot for assisting the transport of the spacer frames (44) by the conveyor slide means (50).

20. Apparatus according to claim 19, in which the conveying member (62) can e lowered, from a transporting position in which it protrudes beyond an upper surface of the plate (10), into a rest position wherein it is hidden below the plate (10).

21. Apparatus according to claim I, in which contact surfaces (49) for the spacer frame (44) are provided on both sides of the clamps (52) of the conveyor slide means (50).

22. Apparatus according to claim 21, in which recesses (80) for the laterally-positioned clamps (68) on the beam of the transfer device (60) are provided in the contact surface (49) of the conveyor slide means (50).

23. Apparatus according to claim 1, further including a clamp (13) for the hollow molding between said bending heads, said transfer device (60) being positioned along an edge of the plate (10) opposite that along which said bending heads are positioned and aligned symmetrically to the clamp (13).

24. Apparatus according to claim 1, further including a clamp (13) for the hollow molding between said bending heads, said transfer device (60) being positioned along an edge of the plate (10) opposite that along which said bending heads are positioned and laterally offset with respect to the clamp (13).

25. Apparatus according to claim 4, in which the clamp of the carriage (101) is formed by two strip-shaped clamping jaws (92, 93) spaced above the plate (10) of the bending apparatus (1).

26. Apparatus according to claim 4, in which one clamping jaw (93) is rigidly mounted on the frame (103) of the carriage (101), whereas the second clamping jaw (92) is connected to piston rods (91) of pressure medium cylinder (90).

27. Apparatus according to claim 1, further including guide means (102) for opposing free ends (45) of the hollow molding bent into a spacer frame (44), said guide means extending between said bending heads and said conveyor slide means.

28. Apparatus according to claim 27, in which the guide means (102) has longitudinally extending grooves (96, 97) wherein the free ends (45) of the spacer frame (44) are guided.

29. Apparatus according to claim 28, in which the grooves (96 and 97) of the guide means (102) are at different levels with respect to the plate (10).

30. Apparatus according o claim 28, in which the bottoms (83 and 84) of the grooves (96 and 97) are mutually offset at the upper end of the guide means (102), so that the free ends (45) of the spacer frame (44) received in the grooves (96 and 97) can overlap each other; the bottoms (83, 84) of the grooves being in alignment with each other at the lower end of the guide means (102).

31. Apparatus according to claim 30, further including a centering shim (58) on the conveyor slide means (50), wherein said bottoms (83, 84) of the grooves (96 and 97) of the guide means (102) are oriented at the lower end thereof to be in aligment with said centering shim (58) of the conveyor slide means (50).

32. Apparatus according to claim 27, in which the guide means (102) is formed by two sheet-metal profiles (81, 81')

33. Apparatus according to claim 32, in which the sheet-metal profile (81') forming the groove (96) is angled, for forming the groove (96), substantially in a U-shape, and has a leg (82) oriented away from the upper surface of the plate (10) and extending obliquely upwardly.

34. Apparatus according to claim 4, in which the carriage (101) and its guide means (102) are mounted so that they can be lowered, from a position protruding beyond the plate (10), to below the plate (10).

35. Apparatus according to claim 34, in which the guide means (102) and the carriage (101) and, respectively, guide rods (104) are attached to an auxiliary frame (106) pivotable about an axis (107) parallel to a slot (100) in the plate (10), for lowering the guide means (102) and the carriage (101).

36. Apparatus according to claim 5, in which the clamps (52) of the conveyor slide means (50) are equipped with hold-down springs (86), free legs (87) of these springs being in contact with spacer frame (44) upon the swiveling of the clamps (52), and urging same against the leg (88), and arranged at the level of the upper surface of the plate (10), a U-shaped profile strip (85) provided on both sides of a centering shim (58) on the conveyor slide means (50).

37. Apparatus according to claim 8, in which the clamps (52) are guided to be displaceable to and fro in parallel to themselves along a guide rail (89) attached to the carriage.

38. Apparatus according to claim 25, in which the clamping surfaces of the clamping jaws (92, 93) form an acute angle with the plane of the plate (10).

* * * * *